US005649811A

United States Patent [19]

Krol, Jr. et al.

[11] Patent Number: 5,649,811

[45] Date of Patent: Jul. 22, 1997

[54] COMBINATION MOTOR AND PUMP ASSEMBLY

[75] Inventors: William P. Krol, Jr., Portsmouth; James S. Uhlman, Jr., Jamestown; Chahee P. Cho, Portsmouth, all of R.I.; Ralph A. Bedingfield, Nashville, Tenn.

[73] Assignee: The United States of America as represented by the Secretary of the Navy, Washington, D.C.

[21] Appl. No.: 613,809

[22] Filed: Mar. 6, 1996

[51] Int. Cl.[6] ..... F04D 29/04

[52] U.S. Cl. ..... 417/353; 417/423.7

[58] Field of Search ..... 417/353, 423.7; 310/90, 90.5

[56] References Cited

U.S. PATENT DOCUMENTS

| | | | |
|---|---|---|---|
| 2,947,467 | 8/1960 | Palmer | 417/423.7 |
| 3,171,356 | 3/1965 | Pensabene | 417/423.7 |
| 3,194,165 | 7/1965 | Sorlin | 417/353 |
| 4,806,080 | 2/1989 | Mizobuchi et al. | 417/353 |
| 4,836,147 | 6/1989 | Morris | 417/423.7 |

*Primary Examiner*—Richard E. Gluck

*Attorney, Agent, or Firm*—Michael J. McGowan; Michael F. Oglo; Prithvi C. Lall

[57] ABSTRACT

A combination motor and pump assembly comprising a housing, a shaft rotatably mounted in the housing, and an impeller fixed to the shaft in the housing, said impeller comprising alternately magnetically polarized portions. The assembly further comprises stator means fixed in the housing adjacent the impeller, the stator means comprising an array of pole pieces and windings associated therewith for receiving electrical alternating current. Fluid inlet means and outlet means are provided in the housing in communication with the impeller. The impeller reacts to current received by the stator means as a motor rotor and rotates in response to excitation of the pole pieces by the current. The rotation of the rotor serves to move fluid in the housing from the inlet to the outlet means.

8 Claims, 2 Drawing Sheets

COMBINATION MOTOR AND PUMP ASSEMBLY

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The invention relates to electrically powered centrifugal pumps and is directed more particularly to a combination electrical motor and fluid pump assembly, wherein a single apparatus constitutes both a motor and a pump.

(2) Description of the Prior Art

The traditional electrically driven centrifugal pump assembly includes (1) an electric motor, (2) a pump, and (3) a coupling system for interconnecting the motor and pump. Proper alignment of the three components must be maintained; otherwise, vibrations cause excessive wear and noise, sometimes leading to premature system failure. The motor output is transferred, via the coupling system, to the pump. The pump transfers energy to the fluid flowing therethrough, increasing the velocity and/or pressure of the fluid. The electric current, converted into torque by the motor, produces waste heat, which must be removed by some means, usually by air or water cooling.

In the traditional assembly, the motor, pump and coupling system are arranged in-line axially. The coupling system typically includes shafts, bearings and linkages. Further space may be required for ventilation or water cooling. In areas in which space is at a premium, as, for example, in underwater vehicles, locating a large number of such assemblies in a given relatively limited area can pose severe problems.

Further, in certain motor and pump applications, as for example for pumping liquids in naval torpedoes, the cooling of the pump motor entails weight considerations because the torpedo system is basically designed for a high speed, relatively short (minutes) run, requiring extraordinarily high performance operation and therefore very hot motor operation. In these applications the elimination of the function of cooling the pump motor results in a significant increase in weight payload carrying capacity of the torpedo.

There is thus a need for a motor and pump assembly which requires less space for the motor and pump functions and which requires no external cooling system, thereby further lessening the space needed.

SUMMARY OF THE INVENTION

It is, therefore, an object of the invention to provide a combination motor and pump assembly wherein a single apparatus serves as both motor and pump, obviating the need for the usual coupling system and the need for having a separate motor and pump aligned axially with each other, thereby substantially reducing space requirements.

A further object of the invention is to provide such an assembly requiring no external cooling system, whereby to further reduce space requirements.

With the above and other objects in view, as will hereinafter appear, a feature of the present invention is the provision of a combination motor and pump assembly comprising a housing, a shaft rotatably mounted in the housing, and an impeller fixed to the shaft in the housing, the impeller comprising alternately magnetically polarized portions. The assembly further comprises stator means fixed in the housing adjacent the impeller, the stator means comprising an array of pole pieces and windings associated therewith for receiving electrical alternating current. Fluid inlet means and outlet means are provided in the housing in communication with the impeller. The impeller reacts to the current received by the stator means as a motor rotor and rotates in response to excitation of the pole pieces by the current. The rotation of the rotor serves to move fluid in the housing from the inlet to the outlet means.

In accordance with a further feature of the invention, a stator windings portion of the assembly is liquid cooled internally, obviating the need for an external cooling system.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
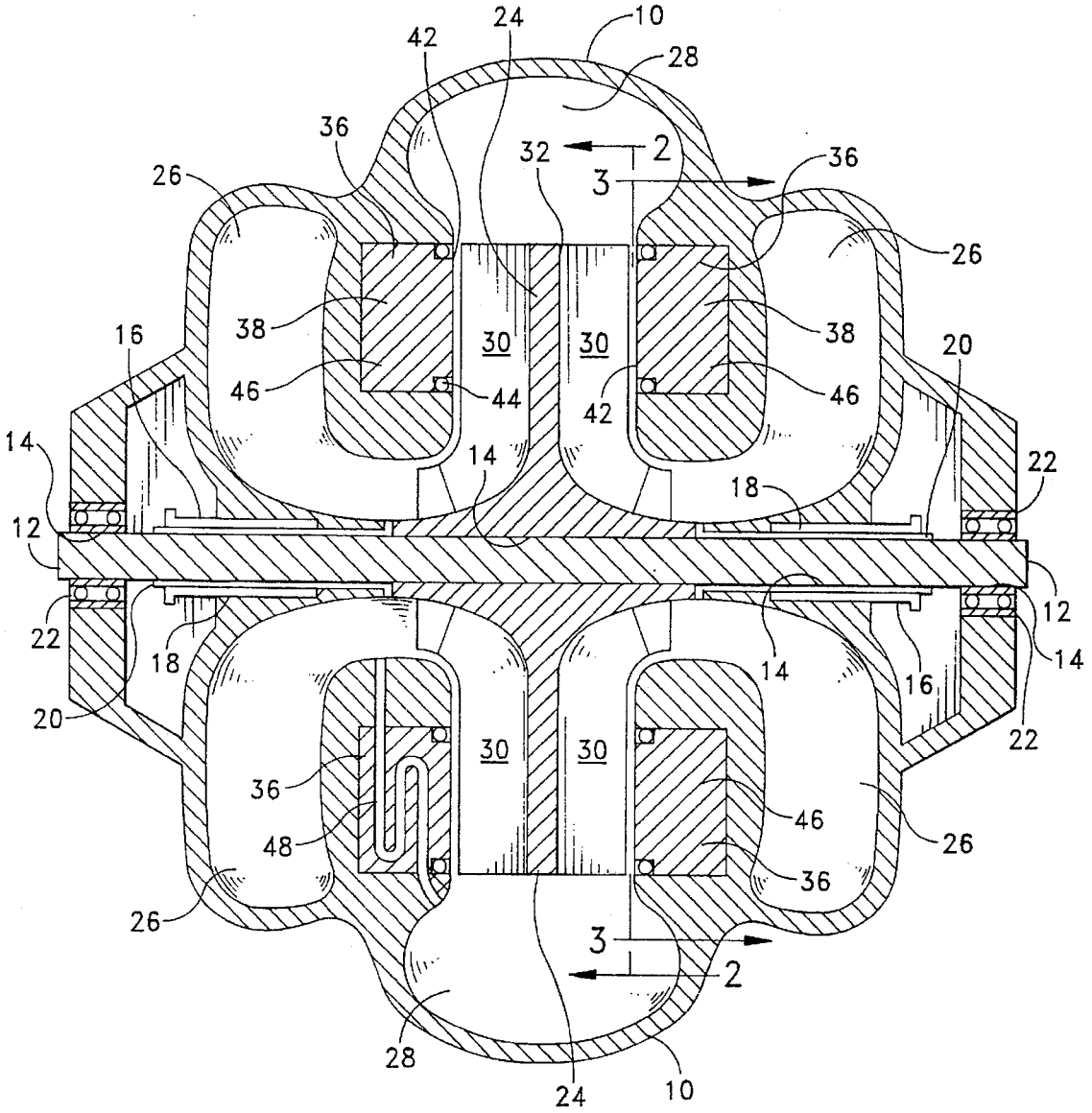
FIG. 1 is a centerline sectional view of one form of combination motor and pump, illustrative of an embodiment of the invention.

Referring to FIG. 1, it will be seen that the illustrative assembly includes a housing 10 which serves to contain the fluid being pumped and to support the other components of the assembly. A shaft 12 extends through central bores 14 in housing 10. The shaft is rotatably disposed within shaft sleeves 16, packing 18, glands 20, and bearings 22 mounted in bores 14.

An impeller 24 is attached to shaft 12 and rotates with the shaft. The rotation of impeller 24 moves fluid from suction ports 26 to discharge ports 28. The suction and discharge ports 26, 28 are sized to provide smooth flow into impeller 24, and to efficiently convert the rotational momentum imparted to the fluid into appropriate pressure head, as is known in the art.

Figure 2:
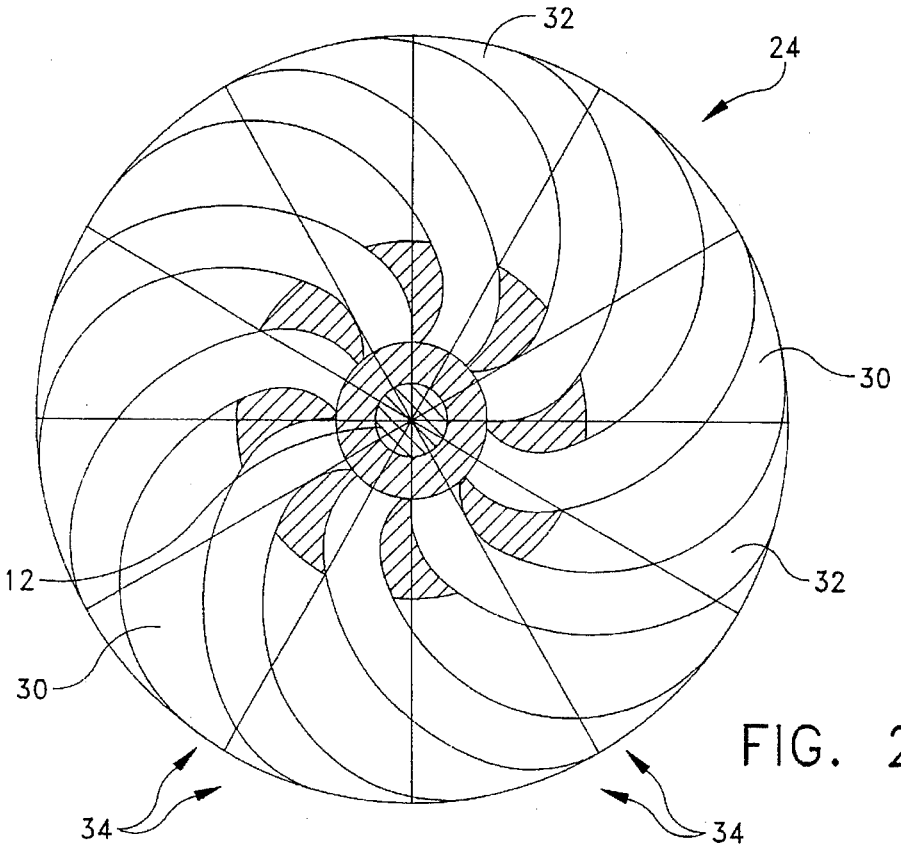
FIG. 2 is a sectional view, taken along line II—II of FIG. 1.

Referring to FIG. 2, it will be seen that impeller 24 includes a number of vanes 30 fixed to a backing plate 32. The number and configuration of vanes 30 is determined to provide a desired capacity and head for a given rotational speed, as is known in the pump art. The vanes 30 are, at least in part, of permanent magnet material. The impeller 24 is divided into a number of angular sectors 34, each assigned a single magnetic polarization which alternates from sector to sector. The size and number of vanes 30 are selected for compatibility with the winding configuration of motor stator elements, to be discussed hereinbelow.

Figure 3:
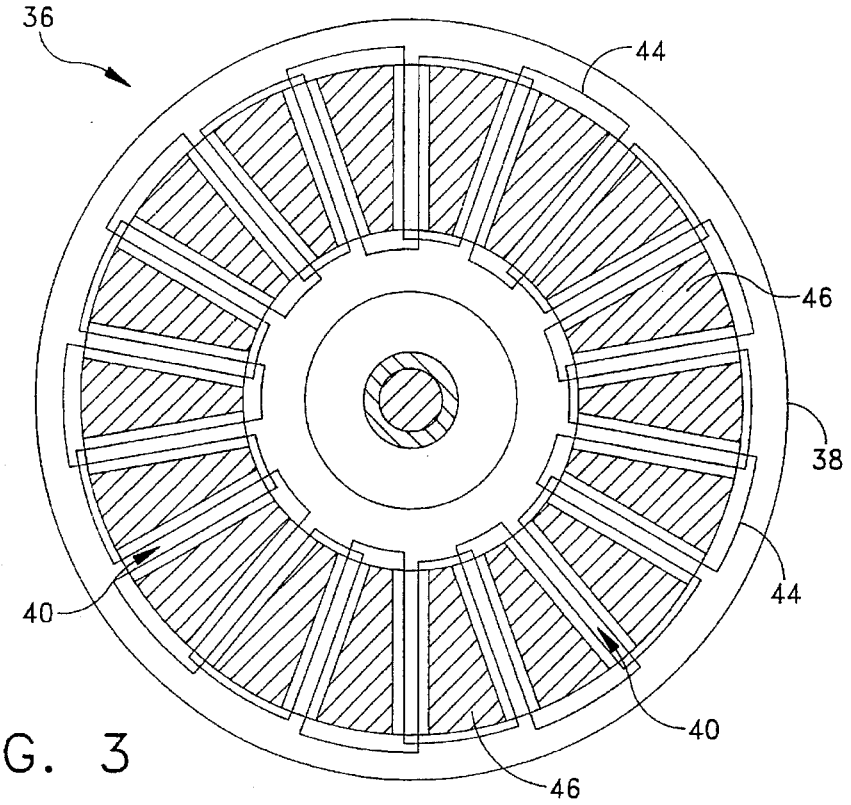
FIG. 3 is a sectional view, taken along line III—III of FIG. 1.

To cause rotation of impeller 24, there is provided motor stator 36. Referring to FIG. 3, it will be seen that motor stator 36 includes a back iron 38. Radial slots 40 are provided on back iron face 42 (FIG. 1), in which slots 40 are wound conductive windings 44 (FIG. 3). The slots 40 define electromagnet pole pieces 46 in the back iron 38. As in conventional electric motors, windings 44 are arranged such that a current flowed through the windings is perpendicular to a magnetic field produced by the impeller vane permanent magnets 30. The windings 44 run primarily perpendicular to shaft 12, which maximizes force induced on impeller 24. The current through the windings 44 is regulated to maximize net torque produced by the windings on the permanent magnets 30 for all angular displacements of impeller 24, as is known in the motor art.

Thus, in the assembly described herein, the vanes 30 serve, simultaneously, as rotor permanent magnet poles for a motor, and as vanes for a pump. The motor of the present invention is a permanent magnet including the stator 36 having a ring of the electromagnet pole pieces 46 and associated windings 44 for receiving polyphase alternating current. The stator pole pieces 46 are opposed to corresponding permanent pole pieces/vanes 30 in the impeller/rotor 24, the pole pieces/vanes 30 being provided with alternating polarities around the impeller.

In operation, the cyclical reversal of polarity of the polyphase excitation current alternately induces forces of attraction and repulsion between a given pole piece 46 of stator 36 and the vane 30 of impeller 24 closest to the magnetic field of the given pole piece 46, causing impeller 24 to rotate. In the inventive assembly described herein, the stator 36 also serves as a pump shroud, or sidewall, for output ducting 28 of a pump, and the rotor also serves as a pump impeller.

Referring to FIG. 1, it will be seen that a passage 48 is disposed in each stator pole piece 46 interconnecting the suction port 26 with the discharge port 28 (one pole piece shown in FIG. 1 having the passage 48). The flow of intake liquid through the pole pieces 46 serves to cool the pole pieces so that external cooling of the assembly is not required.

There is thus provided a combination motor and pump assembly wherein a separate cooling system is not required, and wherein a coupling system, with attendant shafts, bearings and linkages is not required, thereby substantially reducing the volume, weight, and axial extent of the motor/pump assembly. In addition, because fewer components are required, savings in production costs are realized and sources of failure are eliminated, increasing reliability.

It is to be understood that the present invention is by no means limited to the particular construction herein disclosed and/or shown in the drawings, but also comprises any modifications or equivalents within the scope of the claims. For example, while the impeller illustrated is of the double-suction, radial-flow, open type, it will be apparent that the inventive concept applies equally to single-suction impeller, axial flow or mixed flow (axial and radial) impellers, and closed or semi-open impellers. Further, while the shaft is shown herein as horizontal, it will be apparent that the inventive assembly may as well include a vertical or otherwise angled shaft. Still further, the vanes 30 need not all be magnetized. The arrangement of permanent magnets requires that magnetized vanes occur in pairs. If it is required that the total number of vanes be odd, one or more unmagnetized vanes may be used.

What is claimed is:

1. A combination motor and pump assembly comprising:

a housing;

a shaft rotatably mounted in said housing;

an impeller fixed to said shaft in said housing, said impeller comprising radially extending vanes of permanent magnet material;

a stator fixed in said housing adjacent said impeller, said stator comprising an array of pole pieces and windings associated therewith for receiving electrical alternating current;

fluid inlet means and outlet means in said housing in communication with said impeller;

said impeller permanent magnet vanes reacting as motor rotor poles to said current received by said stator and rotating in response to excitation of said stator pole pieces by said current; and said rotation of said impeller serving to move fluid in said housing from said inlet to said outlet means.

2. A combination motor and pump assembly comprising:

a housing;

a shaft rotatably mounted in said housing;

an impeller fixed to said shaft in said housing, said impeller comprising alternately magnetically polarized portions;

a stator fixed in said housing adjacent said impeller, said stator comprising an array of pole pieces and windings associated therewith for receiving electrical alternating current;

fluid inlet means and outlet means in said housing in communication with said impeller;

said impeller reacting as a motor rotor to said current received by said stator and rotating in response to excitation of said pole pieces by said current;

said rotation of said impeller serving to move fluid in said housing from said inlet to said outlet means; and wherein said stator pole pieces are each provided with a passage extending from said fluid inlet means to said fluid outlet means, through said pole piece to cool said pole piece.

3. The assembly in accordance with claim 2 wherein said array of stator pole pieces comprises a ring of said stator pole pieces fixed to said stator.

4. The assembly in accordance with claim 3 wherein said stator pole pieces are of alternating polarity around said ring.

5. The assembly in accordance with claim 3 wherein said stator defines an interior wall of said housing.

6. A combination motor and pump assembly comprising:

a housing;

a shaft rotatably mounted in said housing;

an impeller fixed to said shaft in said housing, said impeller comprising alternately magnetically polarized portions;

a stator fixed in said housing adjacent said impeller, said stator comprising an array of pole pieces and windings associated therewith for receiving electrical alternating current;

fluid inlet means and outlet means in said housing in communication with said impeller;

said impeller reacting as a motor rotor to said current received by said stator and rotating in response to excitation of said pole pieces by said current;

said rotation of the impeller serving to move fluid in said housing from said inlet to said outlet means; and wherein said impeller magnetically polarized portions comprise radially extending vanes in an annular disposition on an impeller backing plate, and said array of stator pole pieces comprises a ring of said stator pole pieces disposed on a stator back iron and opposed to said vanes of said impeller.

7. The assembly in accordance with claim 2 wherein said stator is adapted to receive polyphase alternating current.

8. The assembly in accordance with claim 7 wherein said stator comprises a ring of electromagnet pole pieces and said associated windings, said stator pole pieces being opposed to pole pieces in said rotor, said rotor pole pieces being provided with alternating polarities.

* * * * *